US005127526A

United States Patent [19]

Vigue

[11] Patent Number: 5,127,526

[45] Date of Patent: Jul. 7, 1992

[54] PACKAGE FOR FRAGILE ARTICLES

[75] Inventor: Henry R. Vigue, Waterville, Me.

[73] Assignee: Keyes Fibre Company, Waterville, Me.

[21] Appl. No.: 724,106

[22] Filed: Jul. 1, 1991

[51] Int. Cl.[5] ..... B65D 85/42

[52] U.S. Cl. ..... 206/587; 206/303; 206/419; 206/523; 206/589

[58] Field of Search ..... 206/303, 418, 419, 420, 206/521, 521.2, 521.8, 523, 587-589; 229/2.5 R

[56] References Cited

U.S. PATENT DOCUMENTS

| | | | |
|---|---|---|---|
| 1,945,397 | 1/1934 | Gray | 229/2.5 R |
| 2,776,772 | 1/1957 | Hoda | 229/2.5 R |
| 3,596,822 | 8/1971 | Holley . | |
| 3,608,706 | 9/1971 | Vigue | 229/2.5 R X |
| 3,910,409 | 10/1975 | Fortlage . | |
| 4,120,398 | 10/1978 | Braddon, Sr. | 206/303 X |
| 4,386,702 | 6/1983 | Schultz et al. | 206/523 |

*Primary Examiner*—Bryon P. Gehman
*Attorney, Agent, or Firm*—Connolly and Hutz

[57] ABSTRACT

A molded, one-piece stackable package for fragile articles, such as circuline fluorescent light bulbs with bulb-shaped adapters and attached fittings, has a bottom tray and a top cover mutually hinged together respectively at one side wall. The tray interior has a center support defining an annular trough between the tray side walls and the support in which the circuline bulb will nest without substantial lateral movement. The center support also defines a cavity contoured and tapered to partially receive a light-bulb shaped article. Corner posts and a center foot extend from the outer surface of the bottom of the tray to support the tray. The cover has a second center support with a second socket compartment to receive the other portion of the light-bulb shaped article when the package is in a closed position. The cover also has upstanding arcuate projections adjacent the second center support that contact the circuline bulb to preclude substantial vertical movement of that bulb when the package is in a closed position. Corner posts and a center post extend from the outer surface of the top of the cover to support the cover.

10 Claims, 2 Drawing Sheets

PACKAGE FOR FRAGILE ARTICLES

BACKGROUND OF THE INVENTION

The present invention relates to a package for fragile articles, and, more particularly, to a package for circuline bulbs, such as fluorescent circuline tube bulbs, light bulb adapters and lamp holder fitting attachments, which may be attached to the light bulb adapters.

Converting lamps that use ordinary incandescent light bulbs to lamps that use circuline fluorescent bulbs is a relatively recent measure for energy conservation. Previously, the circuline bulbs, adapters and fittings were packaged using two separate styrofoam pieces, a base and a cover, that could be inserted into a cardboard box. The thick styrofoam base (¼ to ½ inch thick) had a flat bottom of a generally hexagonal shape. Two braces protruded from the upper surface of the base adjacent to two opposite hexagonal sides. A third brace, different from the other two, also protruded from the upper surface of the base a shorter distance and adjacent to a third of the hexagonal sides. A central projection protruded from the upper surface of the base and contained a bulb-shaped contoured socket. Between the braces and the central projection, a shallow annular trough was formed in the upper surface of the base. The circuline bulb partially nested in this shallow trough and between the central projection and the braces. The lamp bulb adapter was partially seated in the socket. The adapter and only a portion of the circuline bulb were then covered by a separate generally rectangular styrofoam cover, having a brace at each end to mate with the two opposite braces that protruded from the hexagonal base. This prior two-piece styrofoam package complicated the packaging of the circuline bulb and adapter. Two pieces had to be stored, making assembly more difficult. The majority of the circuline bulb was not cradled and protected by the cover, but was exposed and could be crushed during storage or shipment.

U.S. Pat. No. 3,910,409 discloses another package structure for a circuline lamp bulb formed from a single rectangular piece of paperboard scored to provide fold-over flaps at opposite ends. To package a circuline bulb, the bulb is laid flat on the paperboard that forms the bottom panel of the carton. The flaps of the paperboard are then folded over through two right angles to provide top panel portions and the topmost portions of the flaps are further folded in through two right angles, tucking the ends under the circuline bulb, to lock the bulb and carton together. The folding operation is time-consuming and more difficult than packaging that requires simple insertion of the circuline bulb. Further, the paperboard carton only partially protects the bulb, leaving much of one side of the bulb exposed to view and thus more subject to breakage during handling. This package does not provide any means for storing a light-bulb adapter or lamp holder fitting.

Dealing with a non-analogous problem, U.S. Pat. No. 3,596,822 discloses a folding lolastic package for storing rigid articles, such as gears or the like (Col. 1, Line 70). The package has a rigid hinge of triangular cross-section and a nipple-recess snap-locking means. The gear or like article is stored in an annular recess surrounding a central hub. The interior walls are all vertical and are not dished to nest the stored article. Such a package with vertical interior walls is not stackable prior to use and would not nest a fragile article to prevent damage during handling.

SUMMARY OF THE INVENTION

The object of the invention is to provide a new and improved package for fragile articles, such as circuline bulbs, of a stackable one-piece construction that will completely cradle the fragile article in a protective cavity. The package must be stable and sufficiently rigid to protect the fragile article from breakage during storage and handling and must overcome all of the disadvantages of prior circuline bulb packages above noted.

The present invention for a package for fragile articles includes a package having a top cover and a bottom tray mutually hinged together by a hinge connecting one side wall of the tray to one side wall of the cover for rotation between an open position and a closed position. The tray and cover are generally rectangular, having side walls that substantially inwardly taper from the outer edges to the bottom of the tray or top of the cover respectively. All of the surfaces of the tray and cover are substantially horizontal or tapered to permit stacking and nesting of the empty open packages.

Looking at the interior of the tray, a centrally located center support, which may be of a generally circular shape, projects upwards. An annular trough or cavity is formed in the tray between the tray side walls and the center support. The center support defines a socket compartment therein that is contoured and tapered to receive a bulb-shaped article. Flat grooves, perpendicular to the socket compartment and not as deep as the socket compartment are also formed in the center support. In line with the grooves, but deeper than the grooves and the socket compartment, a tapered pocket also is formed in the center support Looking at the exterior bottom of the tray, the tapered pocket forms a center foot. In addition corner posts are positioned from the outer surface at each of the four corners of the generally rectangular tray. The tray is substantially supported by the flat surfaces of the corner posts, in conjunction with the center foot surface when the tray rests against or on a flat surface. Additional stabilizing foot projections may also be provided. Reinforcing lips on the nonhinged side wall edges of the tray may also be provided.

As seen from the interior of the cover, the cover has a second center support that defines a second socket compartment contoured and tapered to receive a bulb-shaped article. Adjacent to the second center support are two arcuate projections wit flat outer surfaces that protrude beyond the surfaces of the second center support and the outer edge of the sides of the cover. Between the arcuate projections and the outer side walls are thin arcuate troughs (ridges when viewed from the exterior or top of the cover) to stabilize the side edges of the cover. Flat horizontal ledges connect the hinged and opposite nonhinged side wall of the cover to the second center support. In line with these horizontal ledges and generally perpendicular to the second socket compartment, a deepest tapered pocket is formed in the center of the cover and second socket compartment. When viewed from the top or exterior surface of the cover, the deepest tapered pocket is a center post having a flat surface. Four corner posts, positioned at the corners of the cover, have flat upper surfaces, which in combination with the center post surface, support the cover when the cover is resting against or on a flat surface.

A circuline bulb nests without substantial lateral movement in the trough formed between the center support and the side walls of the tray. A light-bulb adapter with lamp-holder fitting partially nests in the socket compartment in the center support of the tray. With the package in the closed position, the second socket compartment of the cover encloses the partially exposed portion of the light-bulb adapter, substantially preventing lateral or vertical movement of the adapter. The fitting is sandwiched between the flat horizontal ledges of the cover and the groove in the center support of the tray. The arcuate projections from the cover contact the circuline bulb preventing substantial vertical movement of the bulb. Thus bulb, adapter and fitting are securely packaged for storage and transport.

BRIEF DESCRIPTION OF THE DRAWINGS

Numerous advantages of the present invention will be apparent to one of ordinary skill in this art, after reading the detailed description in conjunction with the accompanying drawings, wherein similar reference characters refer to similar parts, and in which.

DETAILED DESCRIPTION

The package for fragile articles according to this invention is useful for safely and securely packaging together circuline articles, such as circuline light bulbs, and bulb-shaped articles, which may or may not have additional parts, such as adapters and the like. The unitary hinged package for fragile articles is molded to substantially finished form of resilient material, such as fibrous pulp material molded against screen-covered, open-face, vacuum-forming molds, after a well-known fashion. The package could also be molded to substantially finished form of foamed plastic, styrofoam or any other material having the requisite cost, strength, resiliency and other characteristics useful for packages of this type. Whatever the material or method of production employed, the package consists of horizontal wall portions and sloping wall portions, but no substantially vertical wall portions, which permits a quantity of like empty packages to be stacked in nested fashion one within another, to provide compact stacks of such empty packages for economical shipment and convenient storage prior to use.

Figure 2:
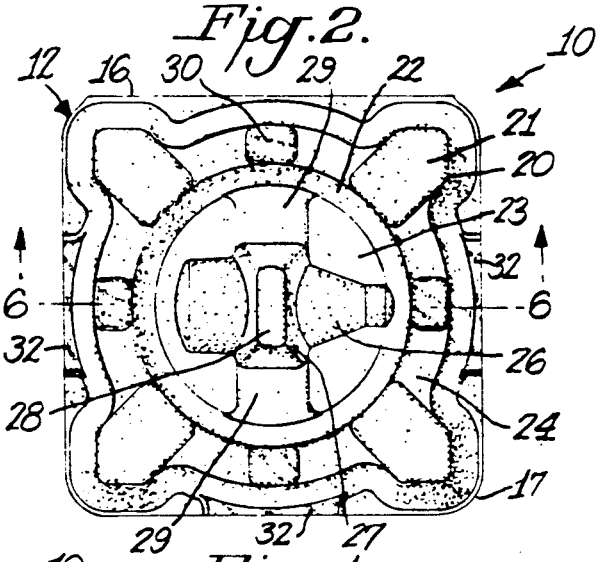
FIG. 2 is a bottom plan view thereof.
Figure 1:
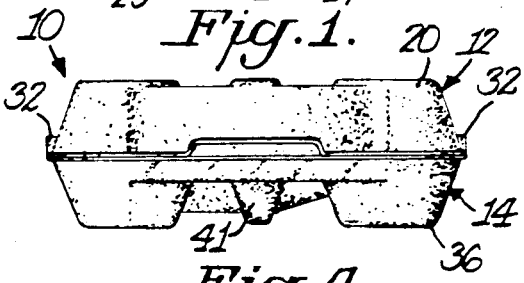
FIG. 1 is a front elevational view of a closed PACKAGE FOR FRAGILE ARTICLES in accordance with this invention.
Figure 3:
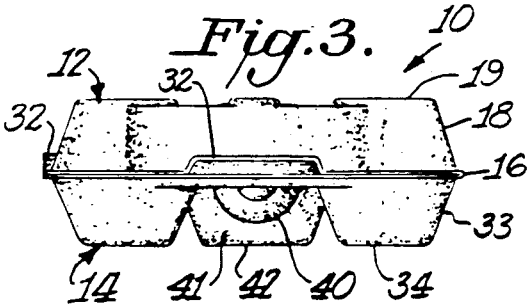
FIG. 3 is a right-side elevational view thereof.
Figure 4:
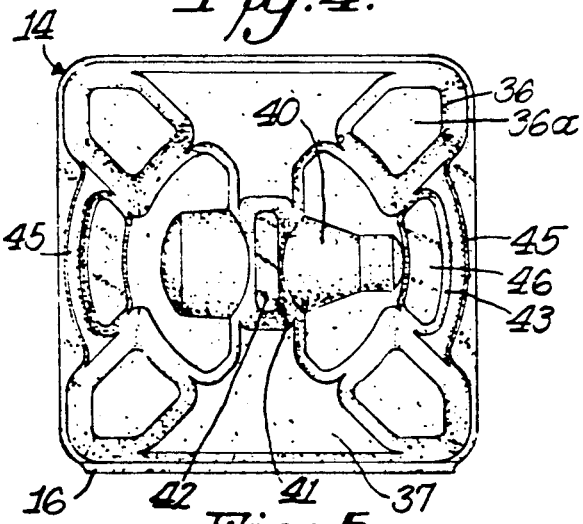
FIG. 4 is a top plan view thereof.
Figure 5:
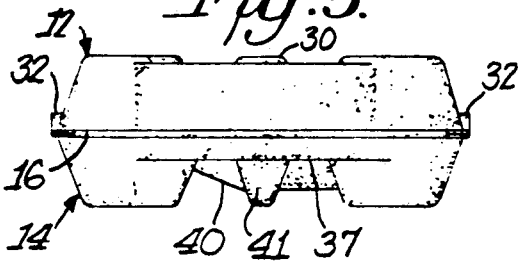
FIG. 5 is a rear elevational view thereof.
Figure 6:
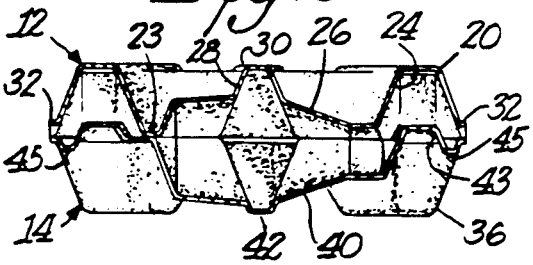
FIG. 6 is a cross-sectional view thereof taken through FIG. 2 along the line 6—6.
Figure 7:
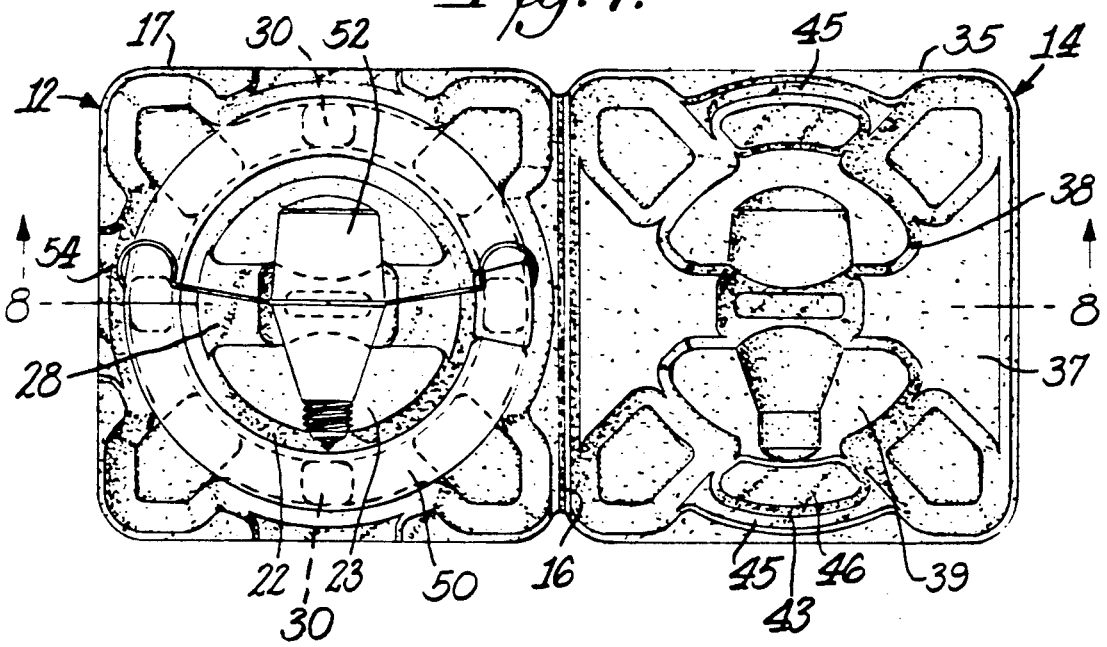
FIG. 7 is a top plan view of an open PACKAGE FOR FRAGILE ARTICLES with a light-bulb adapter, circuline bulb and lamp-holder fitting stored therein.
Figure 8:
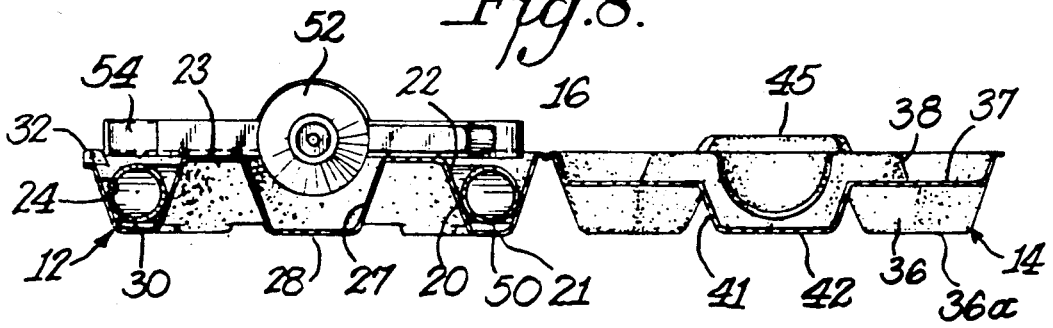
FIG. 8 is a cross-sectional view thereof taken through FIG. 7 along the line 8—8.

The package 10 is shown in the closed position in FIGS. 1-6 and in the open position in FIGS. 7-8. The package 10 has a bottom tray 12 and a top cover 14 mutually hinged together by hinge 16. From the open position (FIG. 7) the cover 14 is rotatable on the hinge 16 to the closed position, covering the tray 12 (FIGS. 1-6).

In a preferred embodiment, the tray 12 is substantially rectangular with side walls 18 generally inwardly tapering from the outer edges 17 to the tray bottom 19. Bottom corner posts 20 having substantially flat surfaces 21 are provided at each corner of the tray 12. The flat surfaces of the bottom corner posts substantially support the tray when the tray 12 is resting against or on a flat surface.

A raised center support 22 having a substantially flat upper surface 23 is formed in the interior central portion of the tray 12 (FIG. 7). Around the center support 22, a substantially annular trough 24 is formed in the tray 12, the annular trough 24 being adapted to receive a circuline fragile article, such as a circuline bulb 50 (FIG. 7). The center support 22 is shown with a circular shape, but it should be readily apparent to those skilled in the art that other shapes may be employed. It is preferable that the shape conform to the object being packaged.

A first socket compartment 26 is formed in the raised center support 22. In a preferred embodiment the first socket compartment 26 is contoured and tapered to hold the side and neck of a bulb-shaped article, such as a light bulb or light-bulb adapter 52.

A tapered center foot 27 having a flat surface 28 is formed in the tray, providing additional support in conjunction with the bottom corner posts 20 when the bottom tray 12 is resting against or on a flat surface. The center foot 27 forms a deeper pocket in the center support 22 when viewed from the upper surface 23 of the center support 22, i.e., the interior of the tray 12. A flat groove 29 may also be formed in the upper surface 23 of the center support 22, to partially support additional parts, such as lamp-holder fittings 54, that may be attached to any light bulb or light-bulb adapter 52 to be held in the first socket compartment 26.

Optionally, the bottom surface 19 of the tray 12 may have one or more stabilizing foot projections 30 to provide additional support when the tray 12 is resting against or on a flat surface. In addition, one or more lips 32 may be formed in the outer edges 17 of the non-hinged side walls 18 of the tray 12 to increase the lateral strength of the side walls.

The cover 14 is substantially rectangular or square with side walls 33 generally inwardly tapering from the outer edges 35 to the cover top surface 34. Top corner posts 36 having substantially flat surfaces **36*a* are provided at each corner of the cover 14 extending from the outer surface. The flat surfaces 36*a* of the top corner posts 36 substantially support the cover 14 when the cover 14** is resting against or on a flat surface.

A raised second center support 38 having a substantially flat, horizontal upper surface 39 is formed in the interior central portion of the cover 14 (FIG. 7). The flat upper surface 39 is substantially the same height as the outer side wall edges 35. A second socket compartment 40 is formed in the raised second center support 38. In a preferred embodiment the second socket compartment 40 is contoured and tapered to hold the side and neck of a bulb-shaped article, such as a light bulb or light-bulb adapter 52. A tapered center post 41 having a flat surface 42 is formed in the second center support 38, providing additional support in conjunction with the top corner posts 36 when the top surface 34 of the cover 14 is resting against or on a flat surface. This center post 41 forms a deeper grooved pocket in the second center support 38, i.e., the interior of the cover.

Substantially flat, horizontal ledges 37 on a different plane, but substantially parallel to the upper surface 39 of the second center support 38 connect the hinged wall and the wall opposite the hinged wall to the second center support 38, which further stabilizes the cover 14. The flat ledges 37 also may contact additional parts to be stored in the package, such as lamp-holder fittings 54 that may be attached to any light bulb or light-bulb adapter 52 to be held in the first and second socket compartments 26, 40 of the package 10.

Upstanding arcuate projections 43, spaced apart from, but substantially adjacent to, the second center support 38 have flat horizontal upper surfaces 46 in a plane parallel to, but above the upper surface 39 of the second center support 38. Between these arcuate projections 43 and the outer edges of the cover side walls 35, arcuate ridges 45 are formed. The arcuate ridges 45 provide added lateral strength to two of the nonhinged side walls 33 of the cover 14.

As shown in FIGS. 7 and 8, a circuline bulb 50 and light-bulb adapter 52 with an attached lamp-holder fitting 54 may be placed in the package 10 for storage and shipment prior to installation. First, with the package 10 in the open position (FIG. 7), the circuline bulb 50 is placed in the annular trough 24 around the center support 22 of the bottom tray 12. The circuline bulb 50 nests in the trough 24 without substantial lateral movement, to protect the bulb 50 from breakage during shipment.

Next, the light-bulb adapter 52, optionally with attached lamp-holder fitting 54, is partially inserted into the first socket compartment 26 so that the lamp-holder fitting 54 partially rests atop the flat surface of the groove 29. A portion of the light-bulb adapter 52 and much of the lamp-holder fitting 54 protrude above the upper surface 23 of the center support 22 of the tray 12. The wide part of the adapter 52 nests in the widest part of the contoured first socket compartment 26, and the threaded neck portion of the adapter 52 lies in the tapered portion of the first socket compartment 26.

Finally, the cover 14 is rotated or folded on the hinge 16 to the closed position (FIGS. 1-6). The portion of the light-bulb adapter 52 that protrudes from the first socket compartment 26 in the tray 12 nests in the second socket compartment 40 of the top cover 14. The wide part of the bulb adapter 52 nests into the wide contoured portion of the second socket compartment 40 and the threaded portion of the bulb adapter 52 nests in the tapered portion of the second socket compartment 40. The flat horizontal surfaces 23 of the center support 22 touch the upper surface 39 of the second center support 38 when the package 10 is in a closed position. The light-bulb adapter 52 is thus prevented from substantially moving laterally or vertically while nested in the first and second socket compartments 26, 40. The horizontal ledges 37 of the cover 14 contacts the lamp-holder fitting 54, sandwiching the fitting 54 between the groove 29 and the horizontal ledges 37. In addition to the restraint to movement provided by the attachment of the fitting 54 to the adapter 52, the lamp-holder fitting is further prevented from substantially moving vertically by the horizontal ledges and the groove 37, 29 and laterally by the hinged and unhinged side walls 18, 33 of the tray 12 and cover 14. The upstanding arcuate projections 43 contact the unnested side of the circuline bulb 50, preventing the bulb from substantially moving in the vertical direction.

The embodiment of the package 10 shown and described herein is intended to be used in combination with a packing carton, box or sleeve and no locking mechanism has been provided. Nevertheless, a locking mechanism, such as a tongue-in-groove or similar closure, could be provided on the package to lock the cover and tray in the closed position.

While the above-described embodiments constitute the presently preferred mode of practicing this invention, other embodiments and functional equivalents are within the scope of the actual invention.

I claim:

1. A molded package for fragile articles, wherein substantially identical empty open packages are nestable one within another in a stack, comprising:

a top cover and a bottom tray, each having substantially inwardly tapered side walls, the tray and cover being mutually hinged together by a hinge connecting one side wall of the tray to one side wall of the cover for rotation between an open position and a closed position, the tray having a center support and defining a substantially annular trough surrounding the center support, said trough being adapted to receive a circuline fragile article, and the center support defining a first socket compartment adapted to receive a bulb-shaped article; and the cover having a second center support, defining a second socket compartment adapted to receive the bulb-shaped article, and one or more raised arcuate projections adjacent to the second center support and projecting beyond the height of the side walls of the cover so that when the package is in the closed position the bulb-shaped article is held in the first and second socket compartments and the circuline fragile article is nested against substantial lateral movement in the trough and stabilized against substantial vertical movement by contact with the arcuate projections.

2. The molded package for fragile articles of claim 1, wherein the tray is substantially rectangular and has corner posts.

3. The molded package for fragile articles of claim 2, wherein the tray has a center foot.

4. The molded package for fragile articles of claim 3, wherein the cover has a center post.

5. The molded package for fragile articles of claim 1, wherein the cover is substantially rectangular and has corner posts.

6. The molded package for fragile articles of claim 1, wherein one or more of the non-hinged side walls of the cover have adjacent ridges.

7. The molded package for fragile articles of claim 1, wherein one or more of the non-hinged side walls of the tray have a lip.

8. The molded package for fragile articles of claim 1, in combination therewith, a circuline fragile article in the annular trough.

9. The molded package for fragile articles of claim 1, in combination therewith, a bulb-shaped article in the first and second socket compartments.

10. The molded package for fragile articles of claim 1, in combination therewith, a fluorescent circuline tube in the trough and a light bulb-shaped adapter in the first and second socket compartments.

* * * * *

UNITED STATES PATENT AND TRADEMARK OFFICE

CERTIFICATE OF CORRECTION

PATENT NO. : 5,127,526

DATED : July 7, 1992

INVENTOR(S) : Vigue

It is certified that error appears in the above-indentified patent and that said Letters Patent is hereby corrected as shown below:

At column 1, line 61, "lolastic" should read --plastic--.

At column 2, line 50, "wit" should read --with--.

Signed and Sealed this

Twenty-first Day of June, 1994

*Attest:*

BRUCE LEHMAN

*Attesting Officer*

*Commissioner of Patents and Trademarks*